US006647677B1

(12) United States Patent
Berger, Jr.

(10) Patent No.: US 6,647,677 B1
(45) Date of Patent: Nov. 18, 2003

(54) WINDOW ASSEMBLY FOR GARAGE DOORS

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 53 days.

(21) Appl. No.: 10/073,642

(22) Filed: Feb. 11, 2002

(51) Int. Cl.[7] ..... E06B 1/04

(52) U.S. Cl. ..... 52/204.1; 52/204.72; 52/656.2; 52/656.5; 52/208; 52/656.4

(58) Field of Search ..... 52/208, 204.72, 52/656.2, 656.7, 656.5, 204.1, 204.54, 204.55, 204.71

(56) References Cited

U.S. PATENT DOCUMENTS 4,280,309 A * 7/1981 Huelsekopf ..... 52/212
5,636,484 A * 6/1997 DeBlock ..... 52/204.5
5,644,881 A * 7/1997 Neilly ..... 52/455
5,765,325 A * 6/1998 DeBlock ..... 52/204.5
6,151,849 A * 11/2000 Twigg et al. ..... 52/208
6,263,627 B1 * 7/2001 Schöñenbach et al. ..... 52/208
6,318,037 B1 * 11/2001 Hansen ..... 52/208
6,553,735 B1 * 4/2003 Wang Chen ..... 52/455

* cited by examiner

*Primary Examiner*—Jeanette E. Chapman
(74) *Attorney, Agent, or Firm*—J. Sanchelima; A. Bordas

(57) ABSTRACT

A window assembly that includes an outer end inner frame assemblies. The outer frame assembly has two horizontal frame members and two vertical frame members. The inner frame assembly includes two horizontal inner members that are slidably mounted to the horizontal frame members. The inner frame assembly also includes two vertical inner members that are mountable on the vertical frame members with fastener members. The outer frame assembly and the vertical and horizontal inner members sandwich or entrap a garage panel with an aperture and a transparent panel to define a window. The outer frame assembly includes a longitudinally and peripherally extending rib member with longitudinal cut-outs. The horizontal inner frame members include longitudinal slots that receive the rib member. Fasteners are used to mount the two vertical inner members to the two vertical frame members keeping the garage panel and the transparent panel sandwiched in place.

2 Claims, 4 Drawing Sheets

WINDOW ASSEMBLY FOR GARAGE DOORS

II. BACKGROUND OF THE INVENTION

1. Field of the Invention

The present invention relates to a window assembly for garage doors, and more particularly, to an assembly that can withstand high winds.

2. Description of the Related Art

Garage doors typically include a number of panels that are transported from a vertical position to a horizontal overhead position over tracks. The window assemblies positioned typically on the uppermost panels are designed to enhance the aesthetic appeal of the door while permitting daylight through. However, the window assemblies used in a conventional garage door includes a frame that cannot withstand high winds, such as those that develop in certain areas like South Florida. The local construction codes have designed wind tests that require reinforcements for these window assemblies and many times, these added structures detract from the aesthetics of the window design.

The present invention, as it will be more fully explained in the following paragraphs, provides for a simple yet sturdy window assembly that includes frame members that can be readily installed around the edges of the aperture defining the window.

III. SUMMARY OF THE INVENTION

It is one of the main objects of the present invention to provide a window assembly for garage door panels that is sturdy enough to withstand high winds, such as those associated with hurricanes and tornados.

It is another object of this invention to provide a window assembly that can be readily installed without requiring time consuming secondary production operations.

It is still another object of the present invention to provide a window assembly that withstands the elements insulating the protected premises.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 is an isometric view of the window assembly mounted to a garage door panel (partially shown) as seen from outside.

FIG. 1*a* shows a front elevational view of a garage door with three window assemblies.

FIG. 1*b* represents an exploded view for one of the preferred embodiments for the present invention.

Figure 6A:
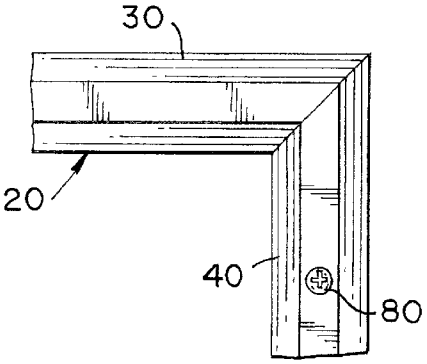
FIG. 6 is an isometric view for the embodiment shown in the previous figures from inside the protected premises.

FIG. 6*a* is a detailed front elevational view of a corner for embodiment shown in previous figures from inside the protected premises.

V. DETAILED DESCRIPTION OF THE PREFERRED EMBODIMENT

Figure 1:
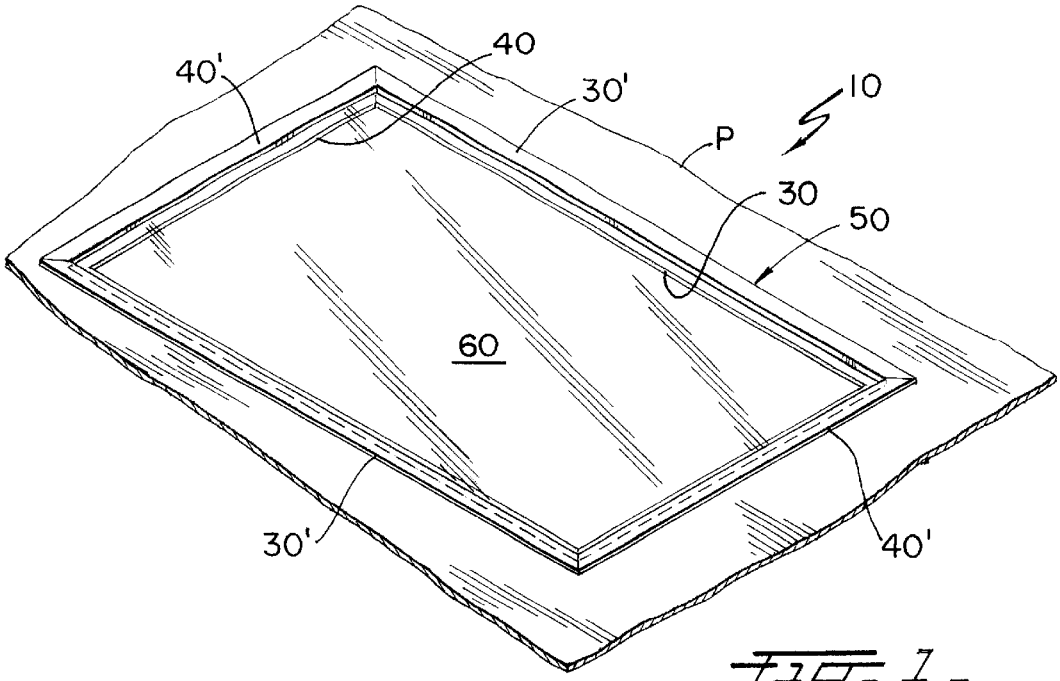
Figure 1A:
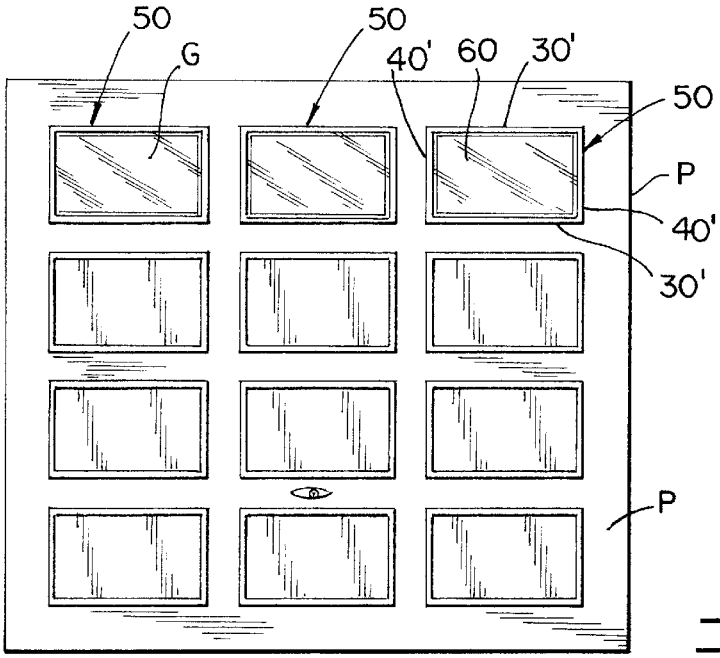
Figure 1B:
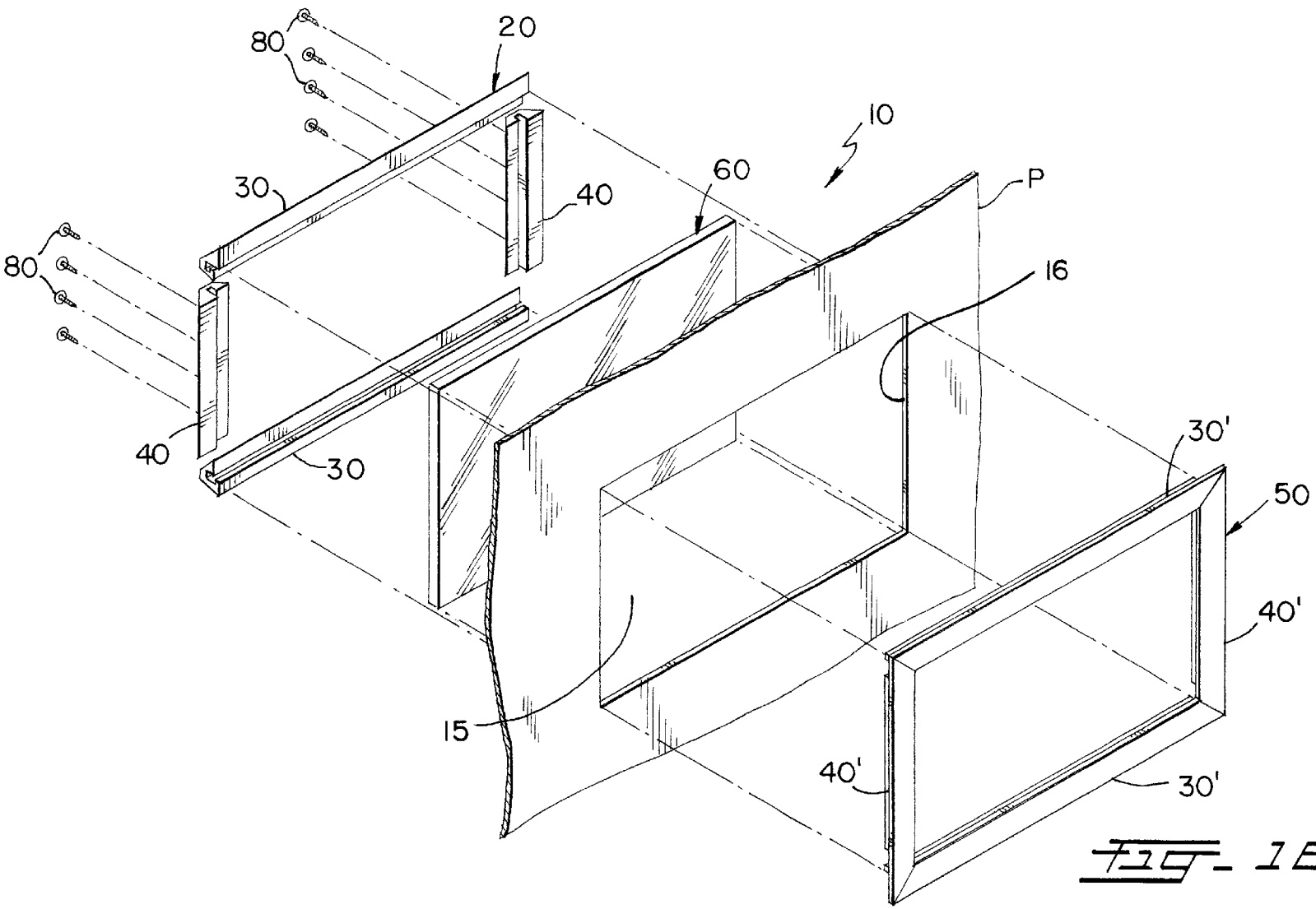

Referring now to the drawings, where the present invention is generally referred to with numeral 10, it can be observed that it basically includes inner frame assembly 20, outer frame assembly 50 and transparent panel 60. Inner frame assembly 20 includes two inner horizontal elongated members 30 and two inner vertical elongated members 40. Outer frame assembly 50 includes two outer horizontal frame members 30' and two outer vertical frame members 40' connected to each other to form a rectangle or square, as seen in FIGS. 1 and 1*a*. A transparent panel 60, made out of glass, plastic or equivalent transparent or translucent material, is securely mounted within window assembly 10 and between assemblies 20 and 50. FIG. 1*b* shows an exploded illustration of the different components on both sides of garage door panel P with rectangular aperture 15 defined by panel edges 16.

Figure 2:
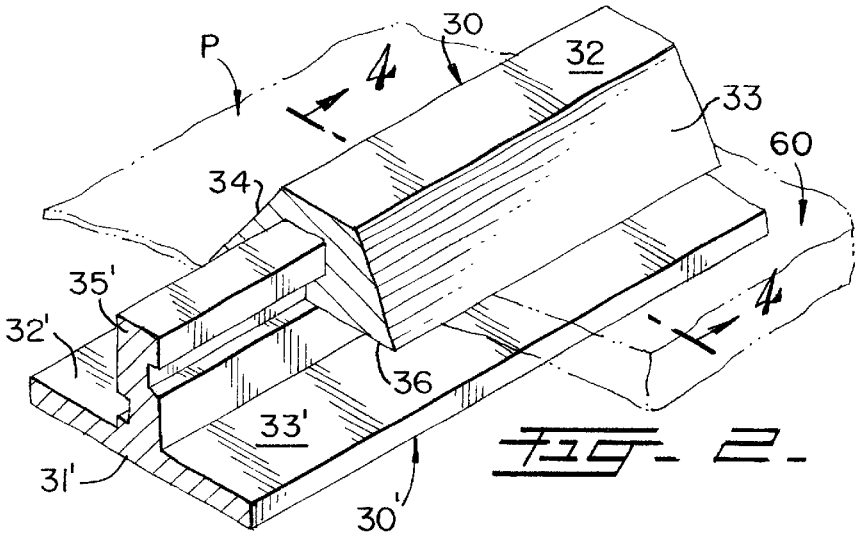
FIG. 2 shows an isometric partial view of a horizontal elongated member mounted to a horizontal frame member. Transparent panel and garage door panel are shown in phantom.
Figure 4:
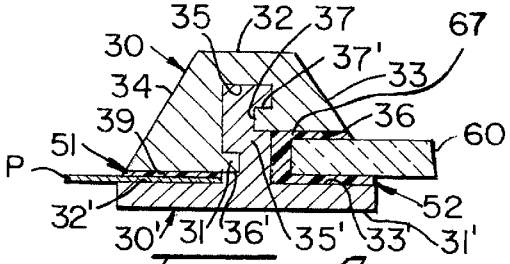
FIG. 4 is a cross-sectional elevation view taken from line 4—4 in FIG. 2.

FIGS. 2 and 4 show isometric and cross-sectional views of a portion of inner horizontal elongated members 30 and outer horizontal frame member 30', slidably mounted to each other. Inner horizontal elongated member 30 includes top end longitudinal surface 32 with inner and outer slanted walls 33 and 34 extending at an angle with respect to longitudinally extending central slot 35. Inner slanted wall 33 is shorter than outer slanted wall 34. Wall 33 ends at longitudinally extending partially inner bottom end surface 36 that extends inside central slot 35 defining longitudinal flange 37. Outer slanted wall 34 ends at longitudinally extending outer bottom end surface 39 that extends partially inside central slot 35 defining flange 31 at a parallel and spaced apart relationship with respect to flange 37.

Outer horizontal frame member 30' has longitudinally extending outer surface 31' common to the entire frame assembly 50, flat outer surface 32', flat inner surface 33' and central rib 35' with longitudinally extending cut-outs 36' and 37' that slidably receive flanges 31 and 37, respectively.

Inner horizontal elongated member 30 and outer horizontal frame member 30', when slidably received by each other, define longitudinal narrow and wide cavities 51 and 52 that receive garage door panel P and transparent panel 60, respectively, with sufficient clearance to permit the use of caulking, adhesive compounds, or equivalent, to sealingly fill in the gaps. Narrow cavity 51 is defined by the separation existing between outer bottom surface 39 and flat outer surface 32'.

Figure 3:
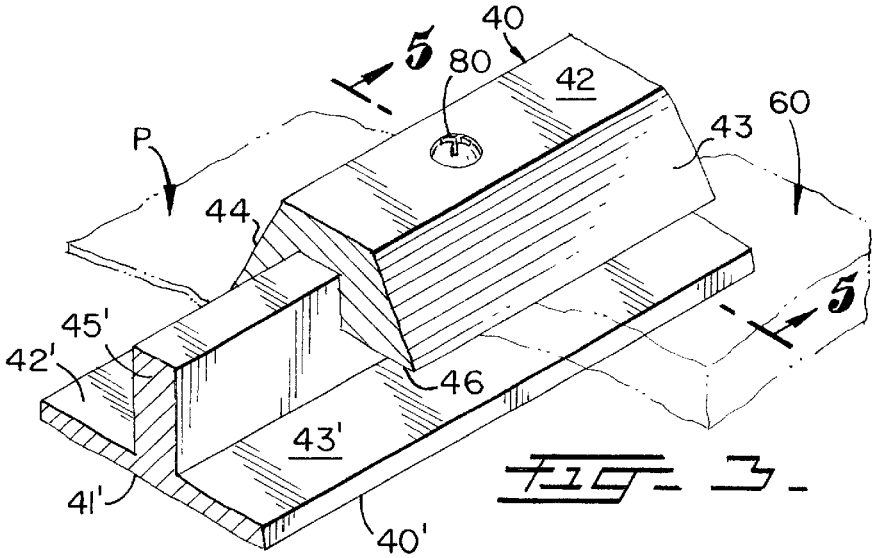
FIG. 3 illustrates an isometric partial view of a vertical elongated member mounted to a vertical frame member. Transparent panel and garage door panel are shown in phantom.
Figure 5:
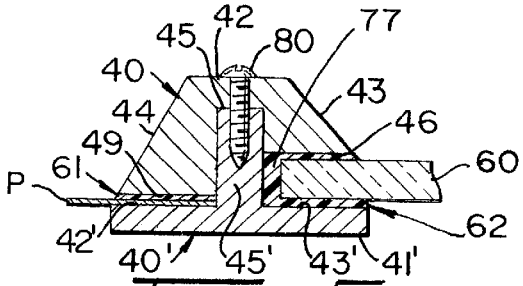
FIG. 5 shows a cross-sectional elevation view taken from line 5—5 in FIG. 3.

Inner vertical elongated member 40 and outer vertical frame member 40' are shown, partially, in FIGS. 3 and 5. Longitudinally extending top surface 42 has inner and outer slanted walls 43 and 44 extending at an angle from its ends ending with inner bottom surface 46 and outer bottom surface 49 respectively. Central slot 45 extends longitudinally. Outer vertical frame member 40' includes longitudinally extending outer surface 41', flat outer surface 42', flat inner surface 43' and central rib 45'. Central rib 45' extends longitudinally and is snugly received within central slot 45.

Longitudinal narrow and wide cavities 61 and 62 have cooperative dimensions to receive garage door panel P and transparent panel 60, respectively. Fasteners 80 are used to secure members 40 to 40'. Sealant members 67 and 77 are used to provide an airtight engagement with panel P and transparent panel 60 respectively.

Figure 6:
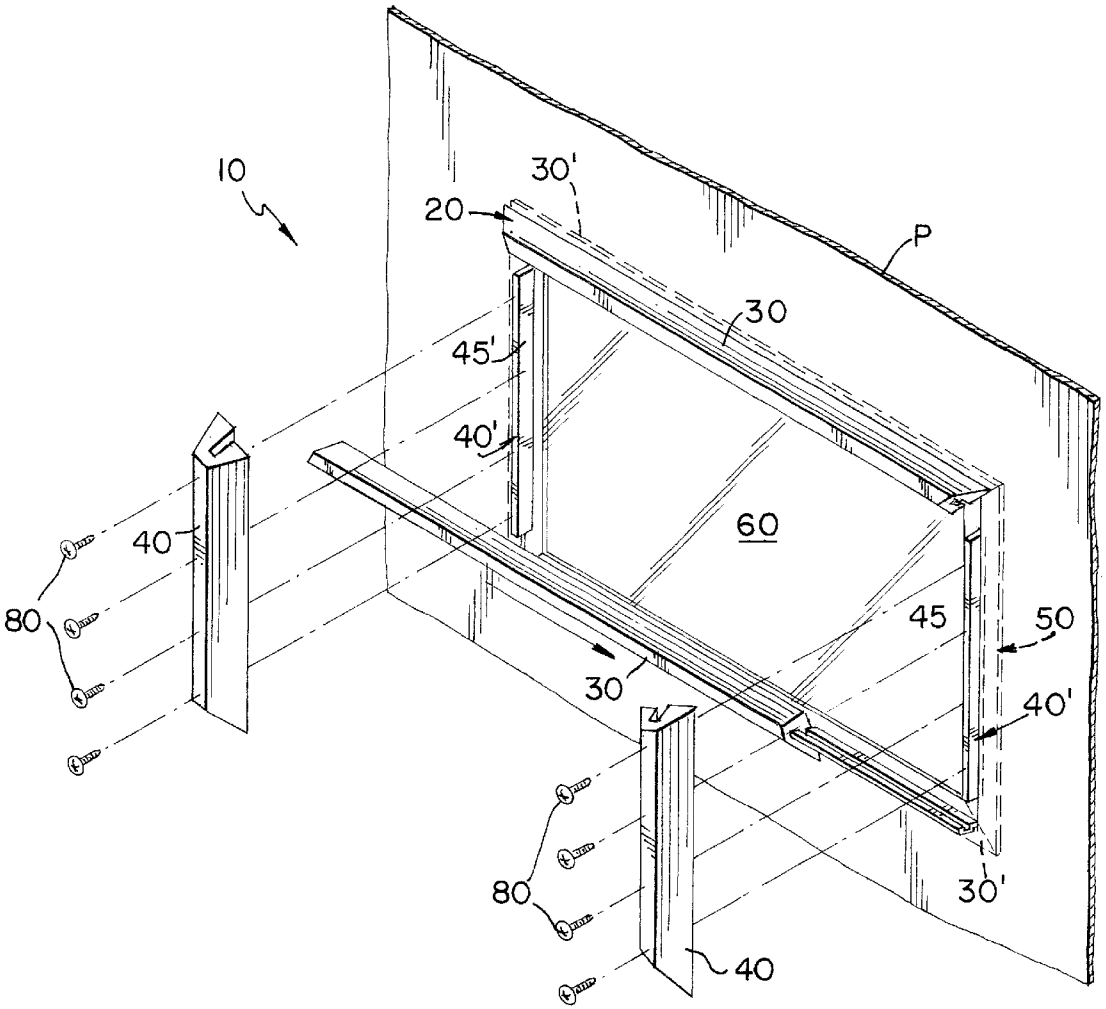

As it can be seen in FIG. 6, central ribs 45' of outer vertical frame members 40' do not run all the way in order to permit the parallel and slidably mounting of inner horizontal elongated members 30 to outer horizontal frame members 30'.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A window assembly for garage doors including panels having at least one rectangular aperture with four edges, comprising:

A) an outer frame assembly including a rectangular common wall having first outer and inner surfaces, said outer frame assembly further including two spaced apart and parallel outer vertical frame members and two spaced apart and parallel outer horizontal frame members mounted to each other, said horizontal frame members including a longitudinal first rib member perpendicularly mounted on said inner surface, said first rib member further including first and second opposite sides having a cut-out on each of said opposite sides, and said vertical frame members including a longitudinal second rib member perpendicularly mounted to said inner surface;

B) two horizontal inner frame members each having a longitudinally extending first end surface with two lateral edges and horizontal inner and outer slanted walls longitudinally extending from said lateral edges, said inner slanted wall being shorter than said outer slanted wall, and said inner and outer slanted walls ending at longitudinal second inner and outer surfaces that extend partially inwardly defining first and second flange members at a parallel and spaced apart relationship with respect to each other and defining a longitudinally and centrally disposed slot so that said longitudinal first rib member is slidably mounted within said slot thereby defining first and second longitudinal cavities for receiving the edge of a rectangular aperture of a panel and a transparent panel between said first inner surface and said second inner and outer surfaces;

C) two vertical inner frame members each having a longitudinally extending second end surface with two lateral edges and further including vertical inner and outer slanted walls longitudinally extending from said lateral edges, said inner slanted wall being shorter that said outer slanted wall, and said inner and outer slanted walls ending at longitudinal third inner and outer surfaces so that third and fourth longitudinal cavities are defined for receiving the edge of a rectangular aperture of a panel and a transparent panel between said first inner surface and said third inner and outer surfaces; and D) fastening means for rigidly mounting said two vertical inner members to said two vertical frame members, respectively, thereby keeping said transparent panel firmly in place.

2. The window assembly set forth in claim 1 further including sealing means applied in said first, second, third and fourth longitudinal cavities.

* * * * *